US011577102B2

(12) United States Patent
Seela

(10) Patent No.: US 11,577,102 B2
(45) Date of Patent: Feb. 14, 2023

(54) UNIVERSAL PERSONAL PROTECTIVE MASK

(71) Applicant: Krithik Seela, Orlando, FL (US)

(72) Inventor: Krithik Seela, Orlando, FL (US)

( * ) Notice: Subject to any disclaimer, the term of this patent is extended or adjusted under 35 U.S.C. 154(b) by 289 days.

(21) Appl. No.: 16/876,817

(22) Filed: May 18, 2020

(65) Prior Publication Data

US 2021/0353976 A1 Nov. 18, 2021

(51) Int. Cl.
*A62B 18/02* (2006.01)
*A62B 18/00* (2006.01)

(52) U.S. Cl.
CPC ..... *A62B 18/025* (2013.01)

(58) Field of Classification Search
CPC ..... A62B 18/025; A62B 23/02; A62B 18/06; A62B 23/00; A62B 23/025; A62B 18/00; A41D 13/11; A41D 13/1107; A41D 13/1115; A41D 13/1123; A41D 13/113; A41D 13/1138; A41D 13/1161; A41D 13/1176
See application file for complete search history.

(56) References Cited

U.S. PATENT DOCUMENTS

| | | | | |
|---|---|---|---|---|
| 10,974,084 | B1 * | 4/2021 | Grinvald | A62B 18/025 |
| 2017/0209720 | A1 * | 7/2017 | Mingo | A62B 23/025 |
| 2021/0120893 | A1 * | 4/2021 | Weng | A62B 23/025 |
| 2021/0299488 | A1 * | 9/2021 | Landis | A41D 13/1176 |
| 2021/0299489 | A1 * | 9/2021 | Semerly | A61M 21/02 |
| 2021/0337889 | A1 * | 11/2021 | Silverberg | A41D 13/0053 |

FOREIGN PATENT DOCUMENTS

| | | | | |
|---|---|---|---|---|
| CN | 104519965 | A * | 4/2015 | A41D 13/1107 |
| DE | 202020102429 | U1 * | 6/2020 | |
| DE | 202020102578 | U1 * | 6/2020 | A41D 13/1115 |
| DE | 202020103002 | U1 * | 7/2020 | A41D 13/113 |
| DE | 202020001329 | U1 * | 8/2020 | |
| KR | 200386879 | Y1 * | 6/2005 | |
| KR | 101544582 | B1 * | 9/2015 | |
| KR | 20160022006 | A * | 2/2016 | |
| KR | 20160001206 | U * | 4/2016 | |
| KR | 200482268 | Y1 * | 1/2017 | |
| KR | 102283754 | B1 * | 7/2021 | |
| KR | 20210110466 | A * | 9/2021 | |
| RU | 195917 | U1 * | 2/2020 | A41D 13/1161 |
| WO | WO-2021222435 | A1 * | 11/2021 | A41D 13/0051 |

OTHER PUBLICATIONS

Translation of KR-200386879-Y1 Jun. 16, 2005.*

* cited by examiner

*Primary Examiner* — Tarla R Patel
(74) *Attorney, Agent, or Firm* — Jason T. Daniel, Esq.; Daniel Law Offices, P.A.

(57) ABSTRACT

A universal personal protective mask includes a main body having a front surface, a back surface, a top edge, a bottom edge, and a pair of side edges that define an internal pocket. An opening is formed along the main body to permit access to the pocket, and a zipper is positioned along the opening to secure the pocket in an open or closed position. The mask body is constructed from a durable machine-washable fabric so as to be reusable, and includes at least one head strap. A gasket is positioned along the inside periphery of the mask body, and a filter insert is removably secured within the pocket. The filter being constructed from myriad of different materials or industry standards to prevent the passage of particulates and harmful organisms.

9 Claims, 4 Drawing Sheets

UNIVERSAL PERSONAL PROTECTIVE MASK

TECHNICAL FIELD

The present invention relates generally to masks, and more particularly to a personal protective mask for use across a wide variety of circumstances.

BACKGROUND

The statements in this section merely provide background information related to the present disclosure and may not constitute prior art.

The COVID-19 pandemic of 2020 highlighted a global issue regarding the need and proper use of personal protective gear, such as facemasks. To this end, disposable personal protective masks, also referred to as "respirators" or "filtering face masks" have long been provided to be worn over the breathing passage(s) of a person's face.

Typically, there are two main reasons for why individuals use such masks. In the first situation, the mask is worn in an environment where the air contains particles harmful to the wearer, for example, doctors working with sick patients, blue-collar workspaces where fine particulates are present (e.g., painters, mills, auto body shops, etc.) and/or outdoor environments where high pollution is found. In the second situation, the mask is worn in an environment where there is a high risk of the wearer infecting others, for example, a sick person in a waiting room or a crowded workspace.

Unfortunately, there does not currently exist a single mask type that is suitable for use in each of these situations. For example, surgical masks, like those that doctors wear, are not airtight and are unable to filter out virus and other particulates from the air They rather are designed to act as a physical barrier against droplets or splatter from transferring from person to person. Many people are under the impression that these masks are effective, but this is not the case. Furthermore, another big problem with these masks is that they are not reusable, as they can only be used for a couple of hours before they lose their function and need to be replaced.

On the other hand, N95-type respirators provide an airtight mask that can filter out pathogens, but with this mask comes numerous problems deterring their use. These masks are very difficult to breathe through, and many users experience a suffocating/claustrophobic effect due to the low airflow. Moreover, these masks are also challenging to put on and also can be very painful, as they have an unnecessarily tight strap. Finally, as with surgical masks, N-95 respirators have a limited life expectancy and are recommended to only be used a couple of times before being discarded.

Accordingly, it would be beneficial to provide a universal personal protective mask that can be configured for use in virtually any situation without suffering from the drawbacks described above.

SUMMARY OF THE INVENTION

The present invention is directed to a universal personal protective mask. One embodiment of the present invention can include a main body having a front surface, a back surface, and a pocket therebetween that is bound by a top edge, a bottom edge, and a pair of side edges. An opening can be formed along the main body so as to permit access to the pocket, and a zipper can be positioned along the opening to secure the same in an open or closed position.

The mask body can be constructed from a durable machine-washable fabric so as to be reusable and can include at least one adjustable head strap. A gasket can be positioned along the inside periphery of the mask body to reduce or eliminate air gaps, and a filter insert can be removably secured within the pocket.

In one embodiment, the filter insert can include a shape and size that is complementary to the shape and size of the pocket area. The filter insert can be constructed from myriad of different materials and/or industry standards so as to prevent the passage of particulates and/or harmful organisms Depending on the working environment, the mask can be used with or without the filter.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
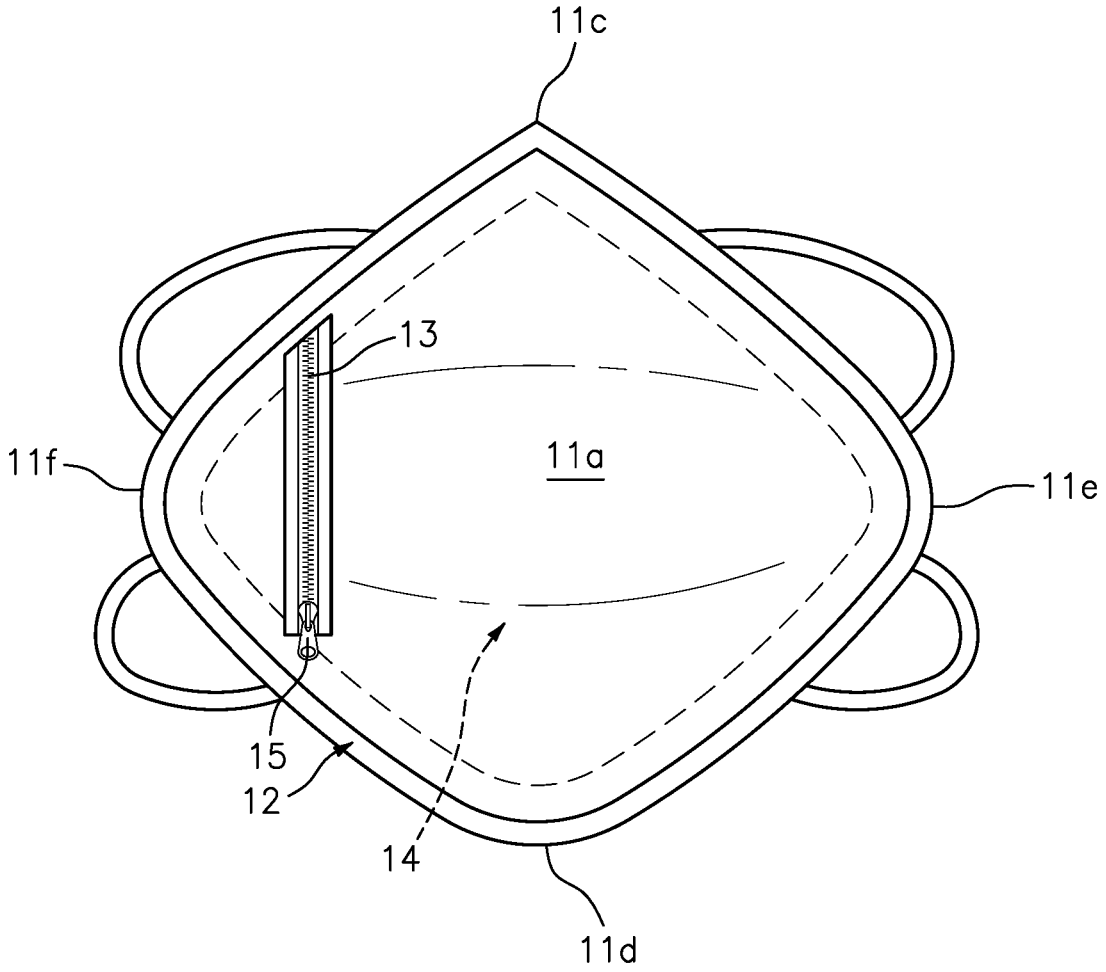
FIG. 1 is a frontal view of the universal personal protective mask, in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described herein, the term "removably secured," and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

FIGS. 1-4 illustrate one embodiment of a universal personal protective mask 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

Figure 2:
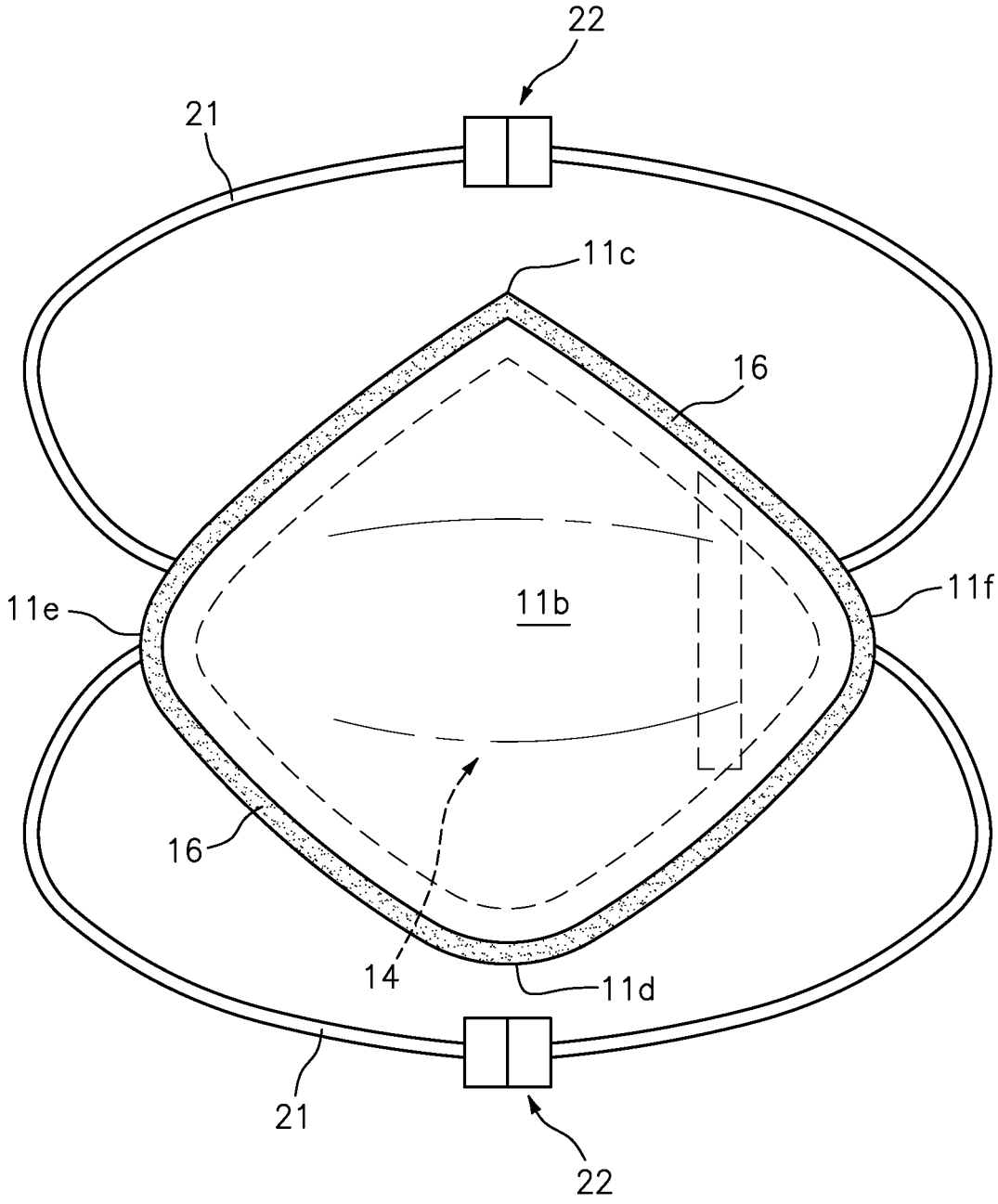
FIG. 2 is a rear view of the universal personal protective mask, in accordance with one embodiment of the invention.

As shown best at FIGS. 1 and 2, one embodiment of the mask 10 can include a main body 11 having a front surface 11*a* and a rear surface 11*b*. In one embodiment, the front and rear surfaces can include substantially identically-shaped pieces of cloth or other such material that are joined together along the top edge 11*c*, bottom edge 11*d* and side edges 11*e* and 11*f*. Each of these edges can be joined via a seam connector 12, such as stitches, liquid seams, hem tape and the like, as is known in the art.

In the preferred embodiment, an opening 13 can be positioned along one of the side edges, such as 11*f*, for example. The opening 13 providing access to a pocket 14 defined by each of the body sections 11*a*-11*f*. As will be described below, the pocket can function to receive one or more filter inserts for allowing the mask to function in a variety of different capacities and to provide varying levels of protection.

Although illustrated as including a generally curved main body 11 having a shape and size that is suitable for covering the mouth and nose of a wearer, the mask body can include any number of other shapes and/or sizes. To this end, the main body can include different sizes so as to conform to the face of an adult, a child, or as a one size fits all.

In either instance, the main body 11 will preferably be constructed from a durable and machine-washable fabric material such as tightly knit cotton, for example. Cotton is a common and breathable material that is widely used for direct contact with human skin. Of course, any number of other fabrics and materials can also be used. Several non-limiting examples include, but are not limited to wool, bamboo, polyester or rayon, for example.

In order to securely position the removable filter (described below) within the pocket area 14, the mask body 11 can preferably include a connector 15 in the form of a zipper having two flexible strips of interlocking projections with a moveable slider for selectively securing the opening 13 into an open or closed position.

Although described above as including a zipper, those of skill in the art will recognize that any number of other types of connectors capable of selectively securing the opening 13 in the closed position may also be utilized herein. Several non-limiting examples include strips of hook and loop material, opposing polarity magnets and/or magnetic elements, and compression fittings such as buttons and snaps, for example. Each of these items can be permanently secured to the main body 11 by a permanent sealer such as glue, adhesive tape, or stitching, for example.

In one embodiment, a gasket 16 can be positioned along the rear surface Jib of the mask body at a location adjacent to each of the top, bottom and side edges 11*c*-11*f*, respectively. In the preferred embodiment, the gasket can include, comprise or consist of closed cell foam, for example, which is a resilient material that can conform to the face of the wearer. Such a feature advantageously functions to reduce or eliminate gaps between the periphery of the mask body and the wearers face during operation, as are commonly found with traditional surgical masks. Of course, any number of other materials may be provided with or instead of the closed cell foam to form the protective gasket.

In one embodiment, the mask 10 can include one or more head straps 21 having a sliding strap adjuster 22, buckle or other such connector for allowing a user to selectively increase or decrease the length of the strap 21. Although shown with regard to a single strap, other embodiments are contemplated wherein multiple straps are provided.

Figure 3:
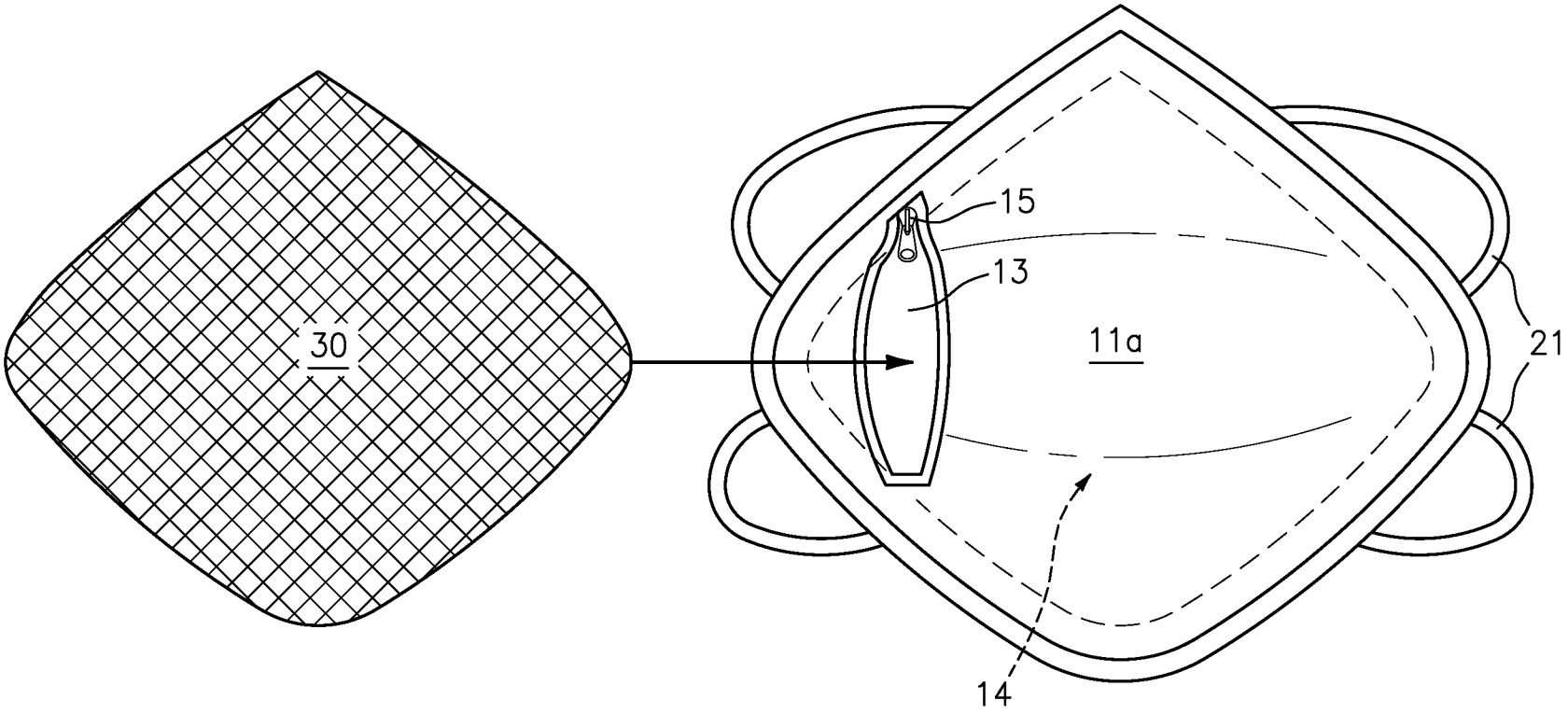
FIG. 3 is a perspective view of the universal personal protective mask and filter insert, in accordance with one embodiment of the invention.

FIG. 3 illustrates one embodiment of a filter insert 30 for use with the above described mask. As shown, the filter insert 30 can include a main body having a shape and size that is complementary to the pocket area 14 of the mask body 11, so as to be removably positioned therein through the opening 13, and secured therein via the connector 15.

As described herein, the filter insert 30 can be constructed from any number of different materials that are specifically chosen for the environment for which the mask is to be used at a given time. For example, one embodiment of the filter insert 30 can be constructed from a fabric material that is overlaid with plastic and/or other materials, as are known in the art to achieve a particular government standard efficiency rating such as N95, N99 or P100 for example, so as to prevent the passage of particulates of varying sizes. One example of a commercially available filter insert for use herein includes the 0.1 micron, 47 mm Nylon Membrane filter that is commercially available by Sterlitech@; however, other filters are also contemplated.

Figure 4:
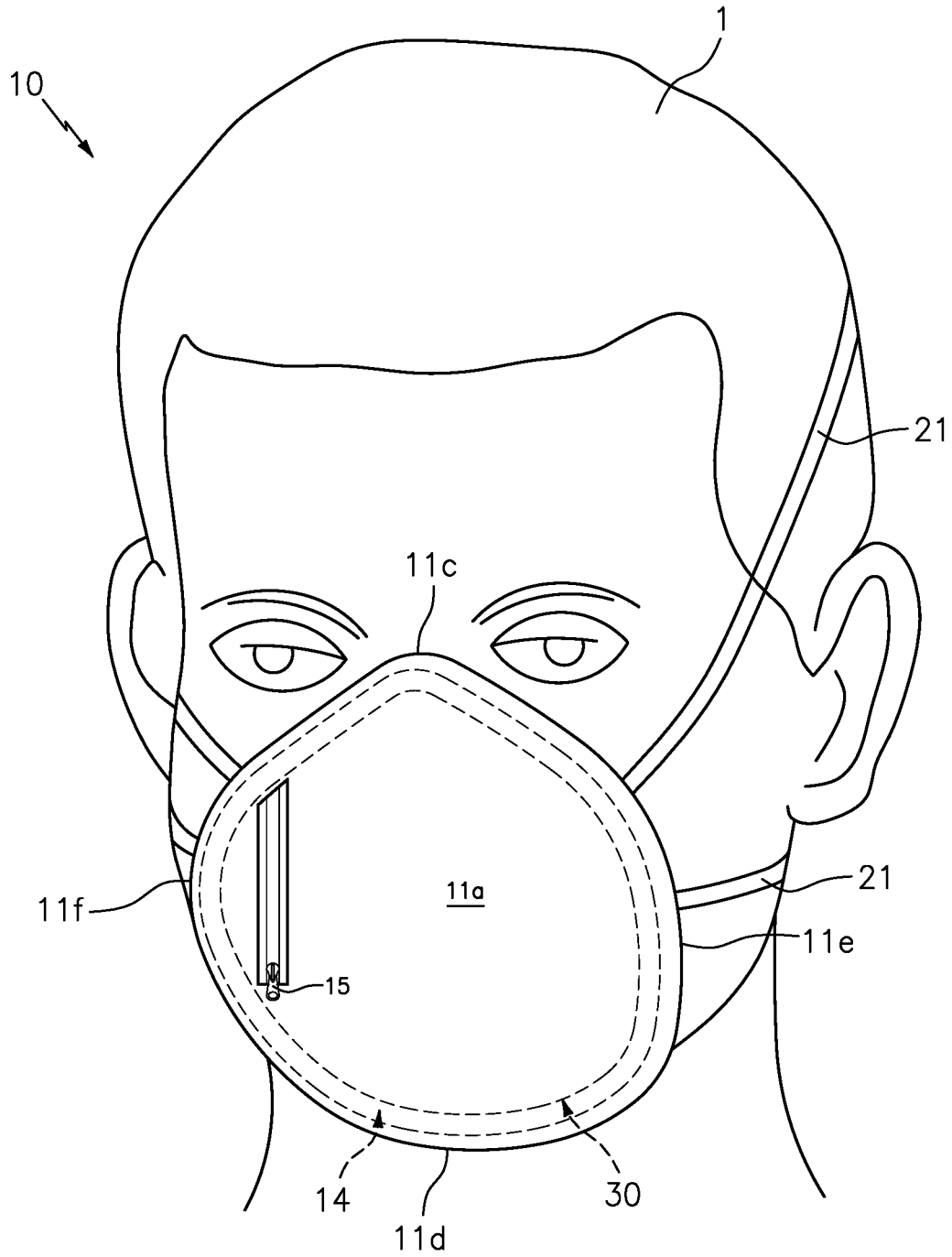
FIG. 4 is a perspective view of the universal personal protective mask in operation, in accordance with one embodiment of the invention.

FIG. 4 illustrates one embodiment of the universal personal protective mask 10 in operation. As shown, once the filter 30 has been positioned within the pocket 14 and secured via the connector 15, the mask body can be secured to the face of a user 1 via the head straps 21. At this time, the mask will completely cover the nose and mouth of the user, and the gasket 16 will function to reduce or eliminate problematic air gaps along the periphery of the mask to ensure a complete seal to the user's face.

When the user has finished their task, the mask can be removed from the users face and the filter 30 can be discarded. Next, the mask body 11 can be washed and upon completion, the mask can be reused with a new filter.

Although described above with regard to a filter, the inventive concepts are not so limiting. To this end, by providing the body of the mask with two discrete layers of material (e.g., 11*a* and 11*b*), the mask body itself can function to block may airborne particulates by itself, and is therefore particularly suitable for use in outdoor environments where bacteria and pathogens are not the primary concern. As such, the mask body 11 is intended to be used both with, and without the removable filter, thus providing dual functionality for a mask owner.

Accordingly, a universal personal protective mask 10 that is constructed as described herein can be adapted for use in virtually any environment.

As described herein, one or more elements of the mask 10 can be secured together utilizing any number of known attachment means such as, for example, glue, and compression fittings, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A personal protective mask, comprising:

a main body having a front surface, a back surface, a top edge, a bottom edge, and a pair of side edges;

a pocket that is formed between the front surface and the back surface of the main body, said pocket forming a shape that is defined by and extends to the top edge, the bottom edge and the pair of side edges;

an opening that is positioned along the main body, said opening being in communication with the pocket;

a head strap that is connected to the main body;

a continuous gasket that consist of resilient closed cell foam material and said continuous gasket is positioned along the back surface of the main body adjacent to each of the top edge, bottom edge and pair of side edges, wherein said continuous gasket reduce or eliminate gap between a periphery of the main body of the personal protection mask and face of a user; and a filter that is removably secured within the pocket of the main body, said filter including a shape and a size that is complementary to a shape and a size of the pocket, wherein the filter comprises at least one of an N95 filter, an N99 filter or a P100 filter.

2. The mask of claim 1, further comprising:

a connector that is positioned along the opening, said connector being configured to selectively secure the opening in an open position and a closed position.

3. The mask of claim 1, wherein the main body is constructed from a durable and machine-washable fabric material.

4. The mask of claim 3, wherein the fabric material is cotton.

5. The mask of claim 3, wherein the fabric material is one of wool, bamboo, polyester or rayon.

6. The mask of claim 1, wherein the main body is curved and includes a shape that is configured to cover a nose and a mouth of a wearer.

7. The mask of claim 1, wherein the head strap includes an adjustable length.

8. The mask of claim 1, further comprising:

a second head strap.

9. A personal protective mask, consisting of:

a main body having a front surface, a back surface, a top edge, a bottom edge, and a pair of side edges;

a pocket that is formed between the front surface and the back surface of the main body, said pocket forming a shape that is defined by and extends to the top edge, the bottom edge and the pair of side edges;

an opening that is positioned along the main body, said opening being in communication with the pocket;

a head strap that is connected to the main body;

a continuous gasket that consist of resilient closed cell foam material and said continuous gasket is positioned along the back surface of the main body adjacent to each of the top edge, bottom edge and pair of side edges wherein said continuous gasket reduce or eliminate gap between a periphery of the main body of the personal protection mask and face of a user; and an N95 filter that is removably secured within the pocket of the main body, said filter including a shape and a size that is complementary to a shape and a size of the pocket.

* * * * *